US006257452B1

(12) United States Patent
Allen

(10) Patent No.: US 6,257,452 B1
(45) Date of Patent: Jul. 10, 2001

(54) POURING DEVICE

(75) Inventor: Michael Allen, Swindon (GB)

(73) Assignee: Castrol Limited (GB)

( * ) Notice: Subject to any disclaimer, the term of this patent is extended or adjusted under 35 U.S.C. 154(b) by 0 days.

(21) Appl. No.: 09/486,914

(22) PCT Filed: Aug. 26, 1998

(86) PCT No.: PCT/GB98/02567

§ 371 Date: May 4, 2000

§ 102(e) Date: May 4, 2000

(87) PCT Pub. No.: WO99/11536

PCT Pub. Date: Mar. 11, 1999

(30) Foreign Application Priority Data

Sep. 4, 1997 (GB) ..... 9718662

(51) Int. Cl.[7] ..... B67B 5/00; B67D 5/32; B67D 5/33; B67D 5/378

(52) U.S. Cl. ..... 222/153.06; 222/472; 222/505; 222/517

(58) Field of Search ..... 222/472, 473, 222/498, 517, 153.06, 153.13, 505, 556

(56) References Cited

U.S. PATENT DOCUMENTS

| | | | | |
|---|---|---|---|---|
| 4,095,712 | | 6/1978 | Perrella | 222/556 |
| 4,141,473 | * | 2/1979 | Hudson | 222/473 |
| 4,607,768 | * | 8/1986 | Taber et al. | 222/556 |
| 4,650,096 | * | 3/1987 | Thatcher | 222/153 |
| 4,911,337 | * | 3/1990 | Rosenthal | 222/498 |
| 5,273,177 | * | 12/1993 | Campbell | 222/498 |
| 5,735,438 | | 4/1998 | Ostrowsky | 222/153.06 |
| 5,797,523 | * | 8/1998 | Gross | 222/498 |

FOREIGN PATENT DOCUMENTS

| | | |
|---|---|---|
| 2 121 270 | 10/1995 | (CA) . |
| 0 346 230 | 12/1989 | (EP) . |

* cited by examiner

*Primary Examiner*—Kevin Shaver
*Assistant Examiner*—Patrick Buechner
(74) *Attorney, Agent, or Firm*—Nixon & Vanderhye P.C.

(57) ABSTRACT

Container pouring devices and methods for liquids. The preferred pouring devices have a first body part which carries a first rear portion and a second front portion, and a second body part which carries a retainer for retaining the device in association with the container, and a biasing member. The device has a first non-pouring position in which the second portion is in sealing engagement with the container, and a second, pouring, position, so that depression of the first portion causes at least part of the second portion to move from the first non-pouring position to the second pouring position, and cessation of depression of the first portion causes the biasing member to urge the first and second portions to readopt the first non-pouring position. Contents may therefore be poured from the container by holding the container with only one hand when the container is in the first, non-pouring, position. The first portion may then be depressed with the thumb or a finger of the holding hand while tipping the container so as to move the pouring device to the second position, and to pour at least part of the contents of the container through the pouring device. Thereafter, the first portion may be released.

26 Claims, 8 Drawing Sheets

Figure 1:
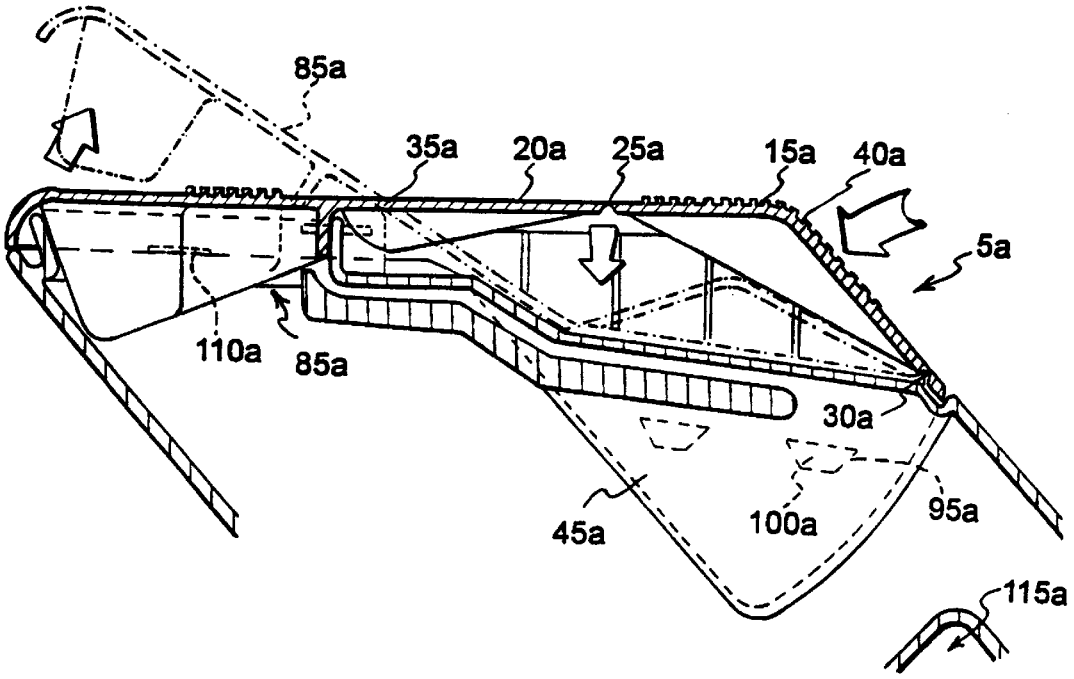

5a
70a
55a
75a
45a
30a
15a
25a
20a
35a
60a
80a
90a
65a
40a
50a

P
20a
25a
35a
45a
15a
40a
55a 20a
25a
35a
45a
15a
40a
55a

FIG 7
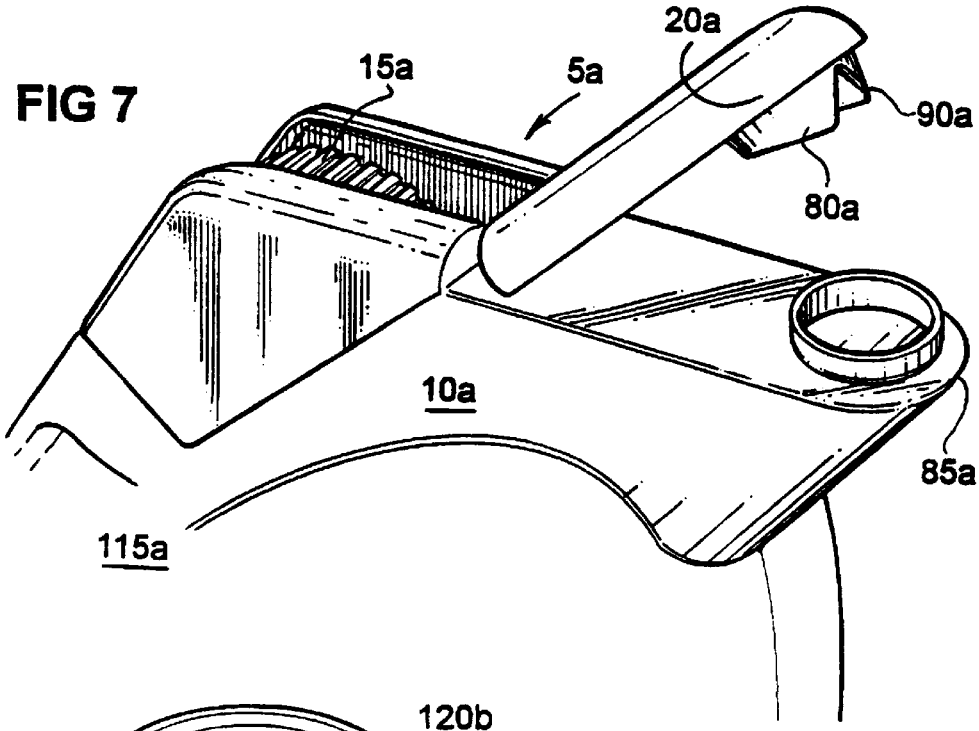
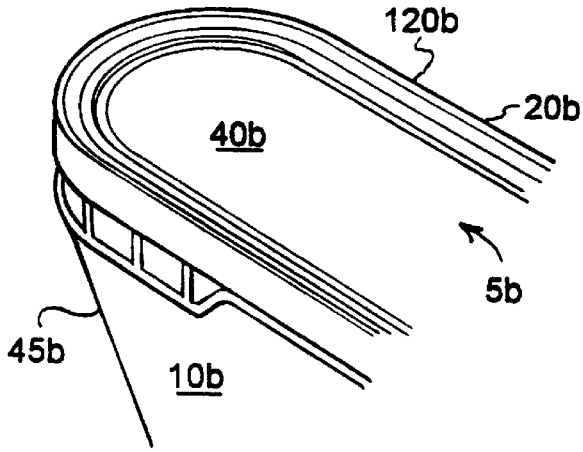
FIG 8
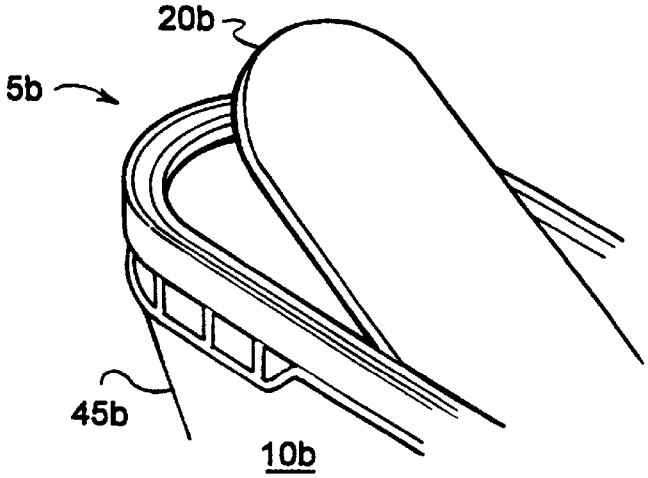
FIG 10

POURING DEVICE

FIELD OF INVENTION

This invention relates to an improved pouring device and to a container including such a pouring device, and in particular, though not exclusively, to a container for liquid.

BACKGROUND AND SUMMARY OF THE INVENTION

A number of problems exist with presently known pouring devices and with container incorporating such pouring devices. For example, containers for engine oil usually comprise a screw lid that screws on to a threaded neck of the container. In use, a user removes the lid from the container, positions the neck of the container over the filling point of a vehicle's engine and pours the oil into the engine. This type of container suffers from the disadvantage that oil can be spilt from the container before the neck is correctly positioned over the filling point of the engine and while the oil is being poured into the engine. This type of container also suffers from the disadvantage that the rate of flow of oil from the container cannot be easily controlled.

It is a further object of at least one embodiment of the present invention to provide a container having a pouring device that allows a user to control the rate of flow of fluid or liquid through the pouring device.

It is a further object of at least one embodiment of the present invention to provide a container that allows a pouring device of a container containing fluid or liquid to be placed in a non-vertical pouring position, which can be, for example, around 45° to the vertical, above a receiver for the fluid or liquid, before any of the fluid or liquid leaves the container.

In particular, it is an object of at least one embodiment of the present invention to provide a container for an engine oil that prevents spillage of the engine oil while the container is being positioned over a filling point of a vehicle's engine and placed in a pouring position.

In particular, it is a further object of at least one embodiment of the present invention to provide a container for an engine oil that allows a user of the container to control the rate of flow of oil from the container in order to reduce or prevent spillage when the oil is poured into a vehicle's engine.

According to a first aspect of the present invention there is provided a pouring device for a container, the pouring device comprising a first, rear portion and a second, front portion and means for retaining the device in association with a container, wherein in a first non-pouring position the second portion is in sealing engagement with the container, while, in use, depressing of the first portion causes at least part of the second portion to move from the first non-pouring position to a second pouring position.

In use the component parts of the pouring device are not remotely separated. This will therefore prevent the component parts of the device from being misplaced.

A user of a container having the pouring device of the present invention can control the rate of flow of fluid or liquid from the container. Controlling the rate of flow of fluid or liquid from a container will allow a user to reduce or prevent spillage of the fluid or liquid.

A user of a container having the pouring device of the present invention can also position the container in its non-vertical, pouring position before any fluid or liquid leaves the container. This will therefore allow a user to prevent the fluid or liquid from prematurely leaving the container.

Advantageously a first hinge is provided between the first and second portions.

A second hinge may also be formed at a rearmost end of the first portion.

The first portion may be of a bent planar form.

The second portion may have a pivot point provided thereupon spaced from the first hinge.

Thus, in use, depression of the first portion may cause flexure of the first hinge thereby causing the second portion to pivot about the pivot point, the at least part of the second portion thereby being caused to move from the first non-pouring position to the second pouring position.

Depression of the first portion is preferably achieved by the action of downward pressure of a user's thumb or finger on the first portion, preferably on a thumb-receiving depression on the first portion.

Advantageously the device comprises a first body part which carries the first and second portions and preferably also a second body part which carries means for retaining the device in association with the container.

The first body part and the second body part preferably form a one-piece component.

The first and second body parts may be retained in association with one another by a third hinge.

Biasing means may be provided such that, in use, ceasing depression of the first portion causes the biasing means to urge the first and second portions to readopt the first non-pouring position.

The second portion may carry first and second lugs at the pivot point, which lugs are capable of being received within corresponding first and second recesses formed in the second body part.

The second portion may carry sealing means which, when the second portion is in the first position cause a seal to be formed between the device and a pouring aperture.

In a first embodiment the pouring aperture is not formed on the device but is provided on the container.

In a second embodiment the pouring aperture is formed on the second body part.

The sealing means may provide an inverted V-shaped slot at a front most portion thereof.

The device may incorporate an anti-glug device. The anti-glug device is preferably integral with the pouring device.

The second body portion may carry one or more inwardly facing lugs or clips which, in use, co-act with respective apertures or recesses formed in the container to retain the device and container together.

Advantageously the device may provide tamper evident means, for example, frangible tamper evident lugs formed between the first portion or second portion and the second body part, first depression of the first portion causing the lugs to shear. The tamper evident means is preferably clearly visible to a user.

The device may also provide a frangible transit lock, for example frangible seal(s) between the first and second body parts, which seal(s) is/are broken by depression of the second portion.

The device may also provide a locking mechanism for locking the second, front portion in the non-pouring position. This locking mechanism will prevent leakage from the container when it is in transit or when it is in storage.

The device may be made of a moulded plastics material.

According to a second aspect of the present invention there is provided a container including a pouring device according to the first aspect of the present invention.

The container may include a handle. The container may include two or more handles.

In use, a user may hold the container with one hand and with a thumb/finger of that hand depress the first portion of the device thereby causing the second portion to move to the second position allowing pouring of contents of the container. The container of the present invention can therefore be used with just one hand.

The container may be adapted for containment of liquids, and particularly viscous liquids.

The container may be particularly adapted for contaminant of liquid hydrocarbons, for example, oil, and, in particular, engine oil.

According to a third aspect of the present invention there is provided a method of pouring contents from a container, the container including a pouring device according to the first aspect of the present invention, the method comprising:

holding the container with one hand;

depressing the first portion with a thumb/finger of that hand whilst tipping the container so as to pour at least part of the contents of the container;

and releasing the first portion.

Advantageously releasing of the first portion causes the second portion to readopt the first non-pouring position thereby closing the container.

BRIEF DESCRIPTION OF THE ACCOMPANYING DRAWINGS

Figure 2:
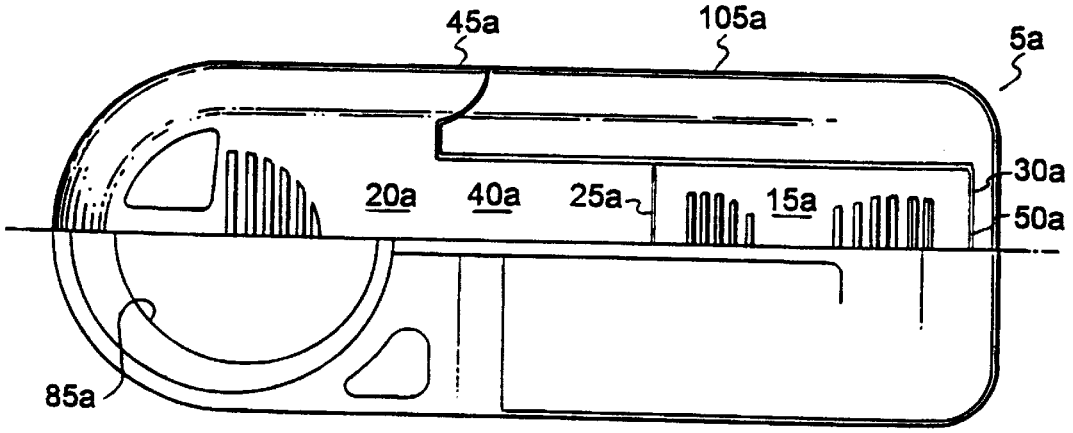
Figures 3, 4A, 4B:
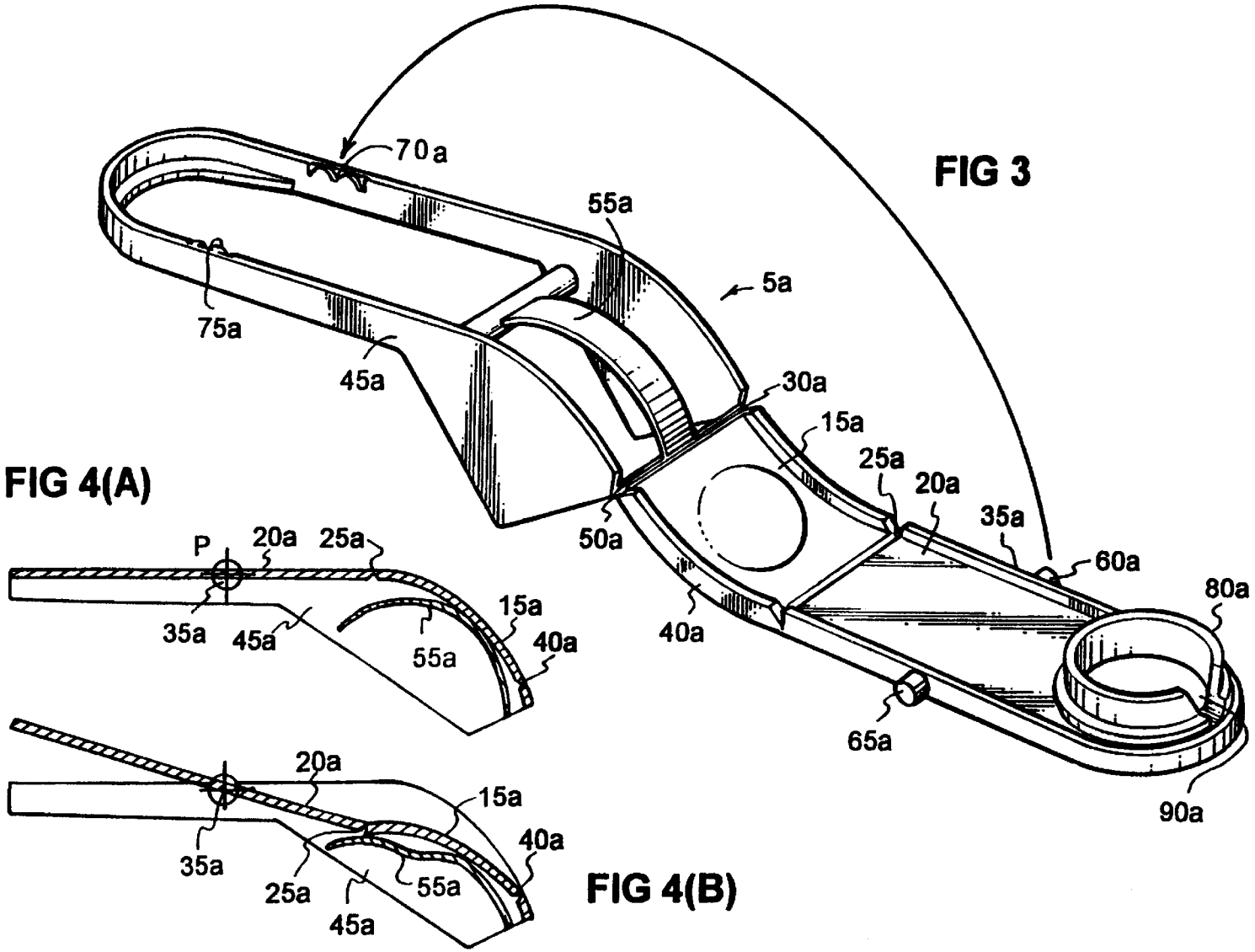
Figure 5:
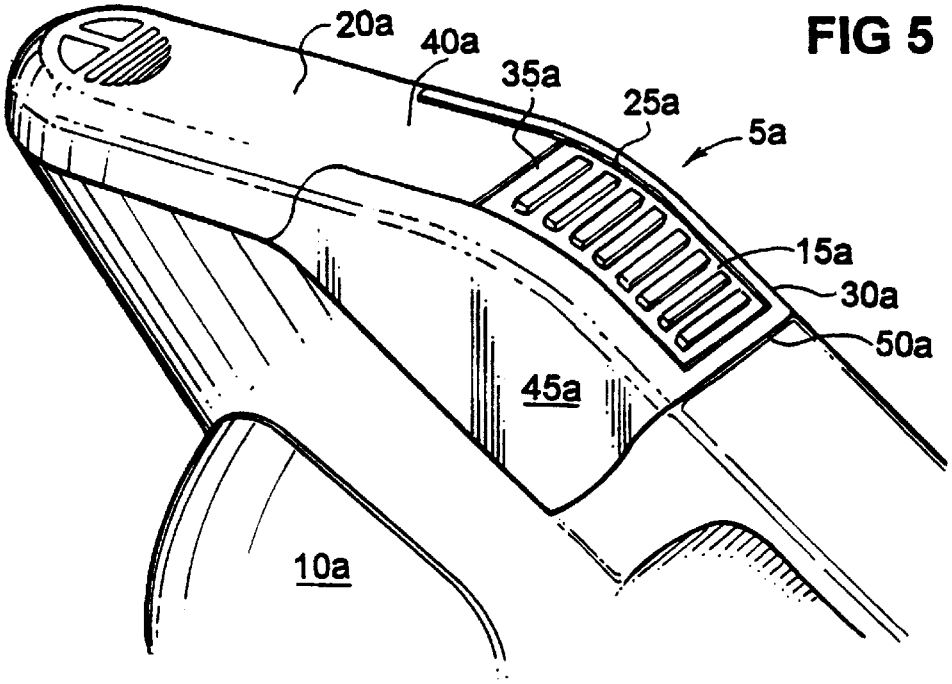
Figure 6:
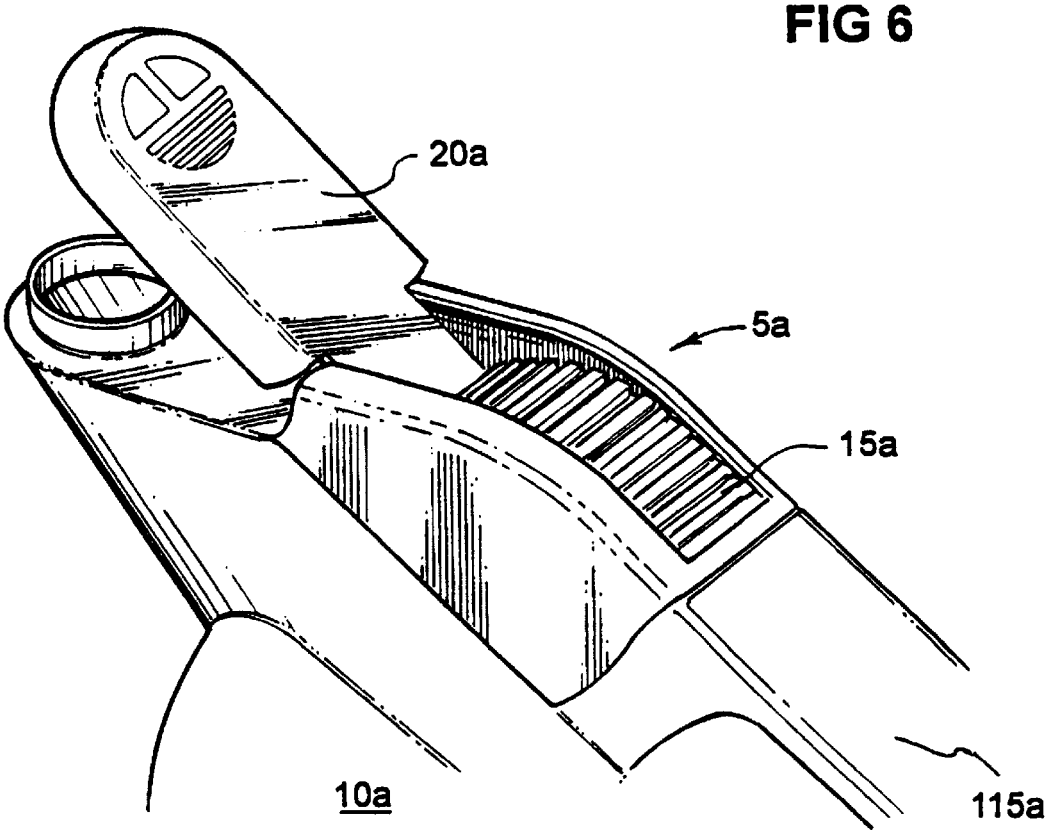
Figure 9:
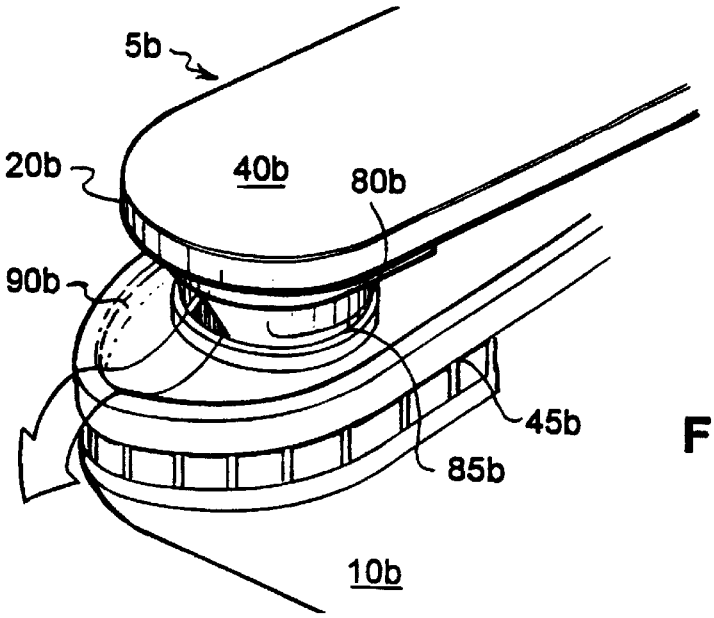
Figure 11:
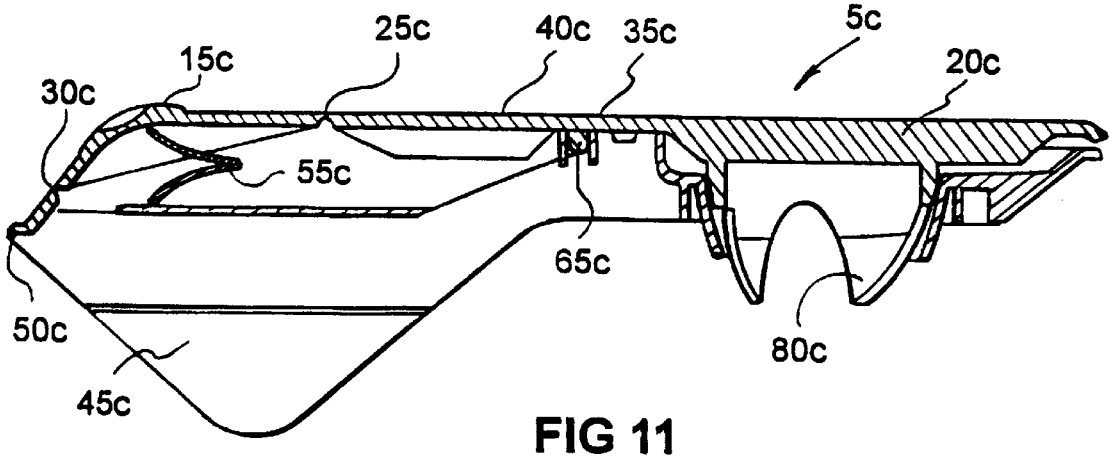
Figure 12:
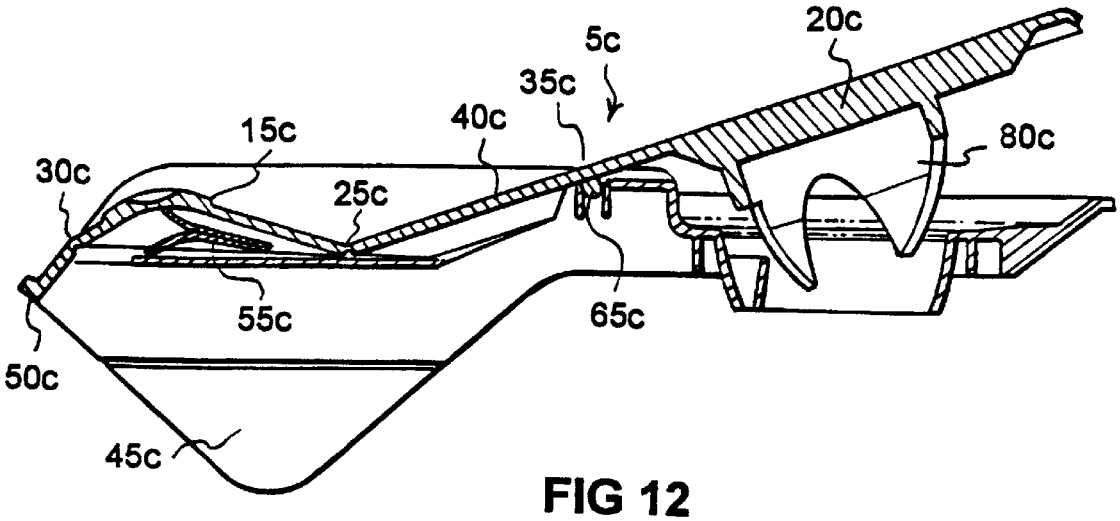
Figure 13:
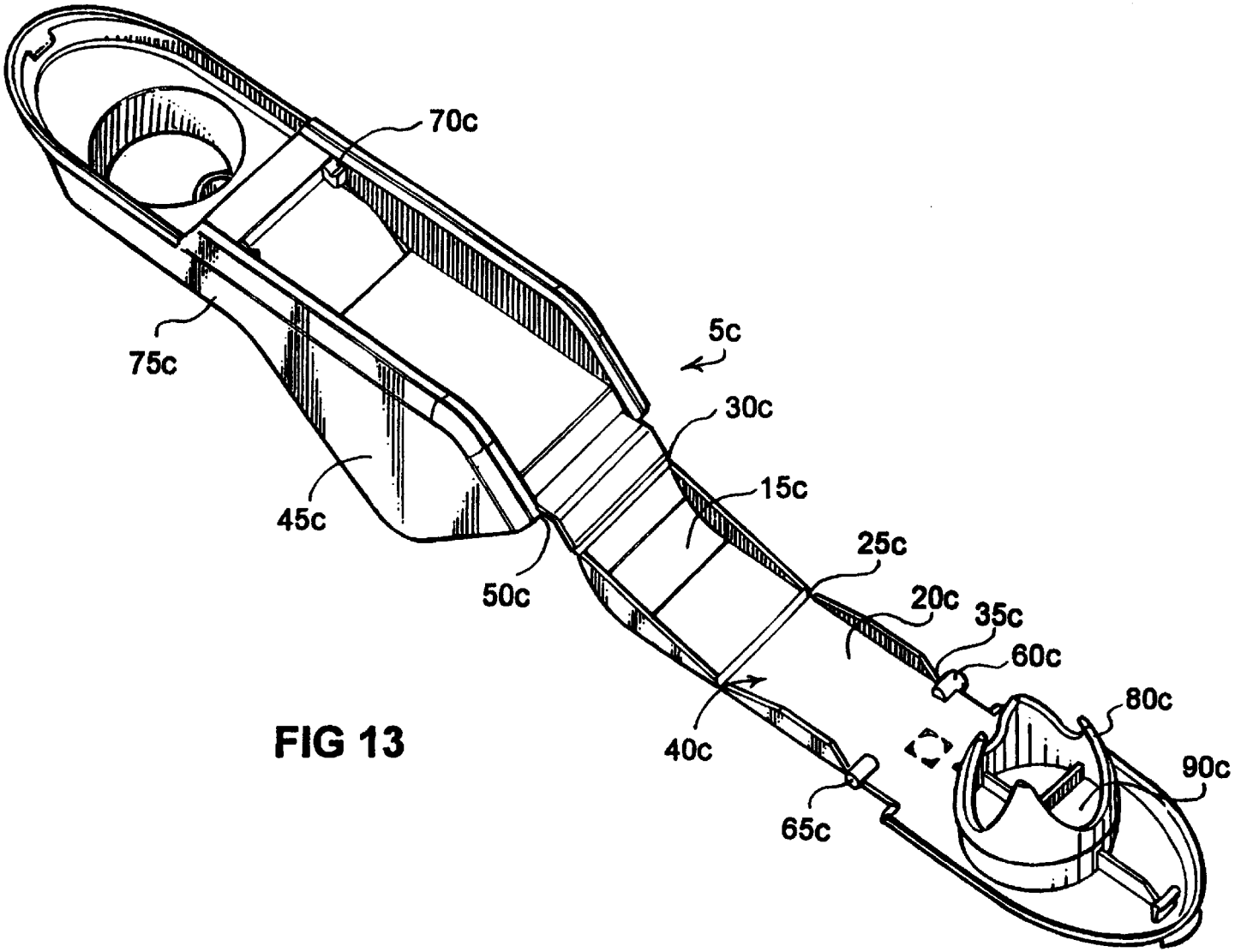
Figure 14:
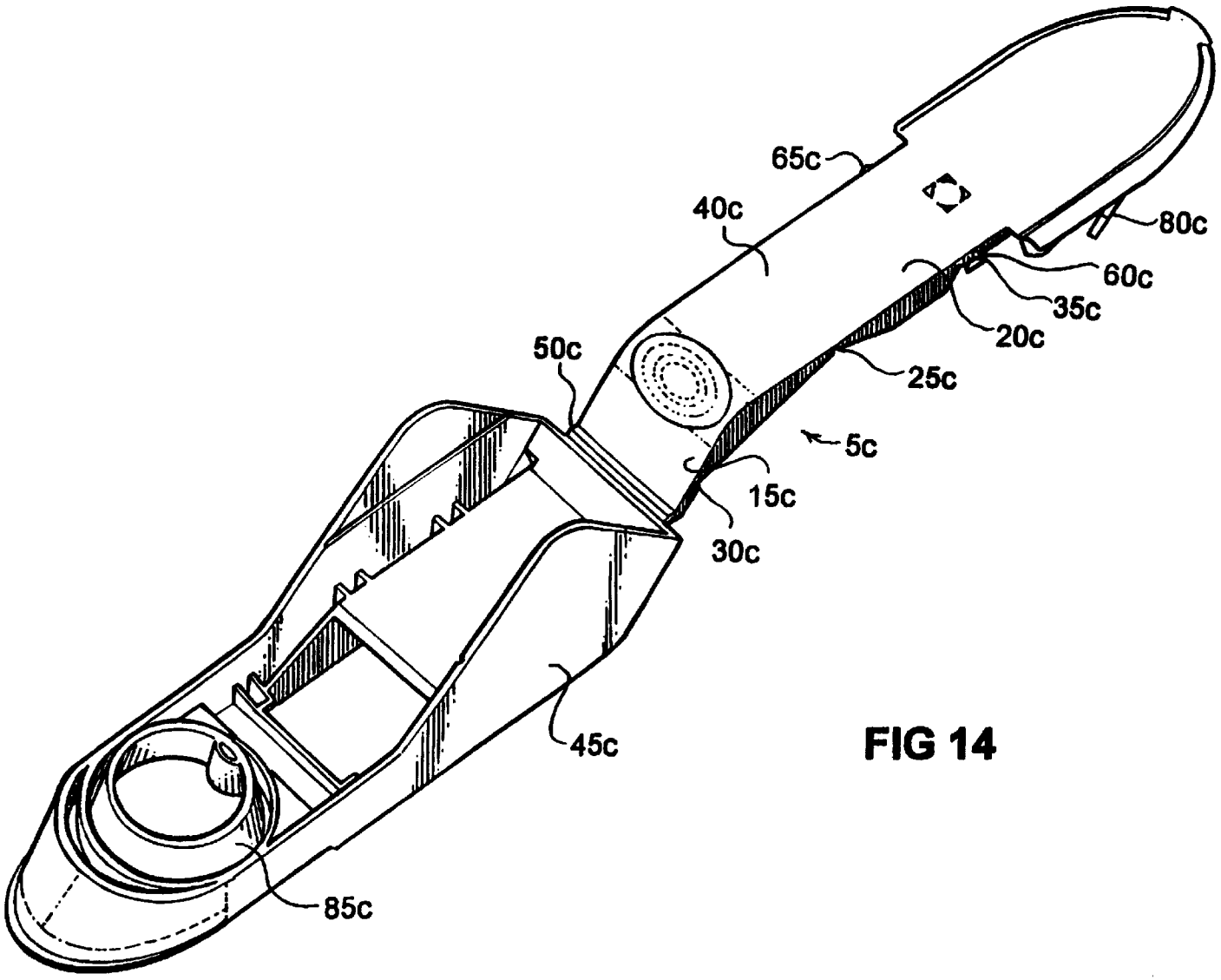
Figure 15:
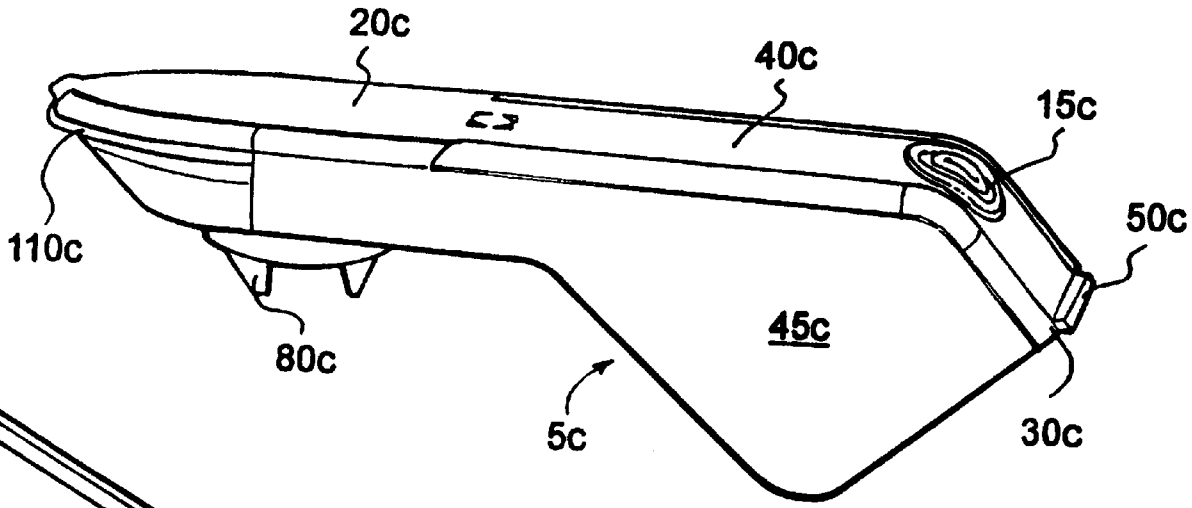
Figure 16:
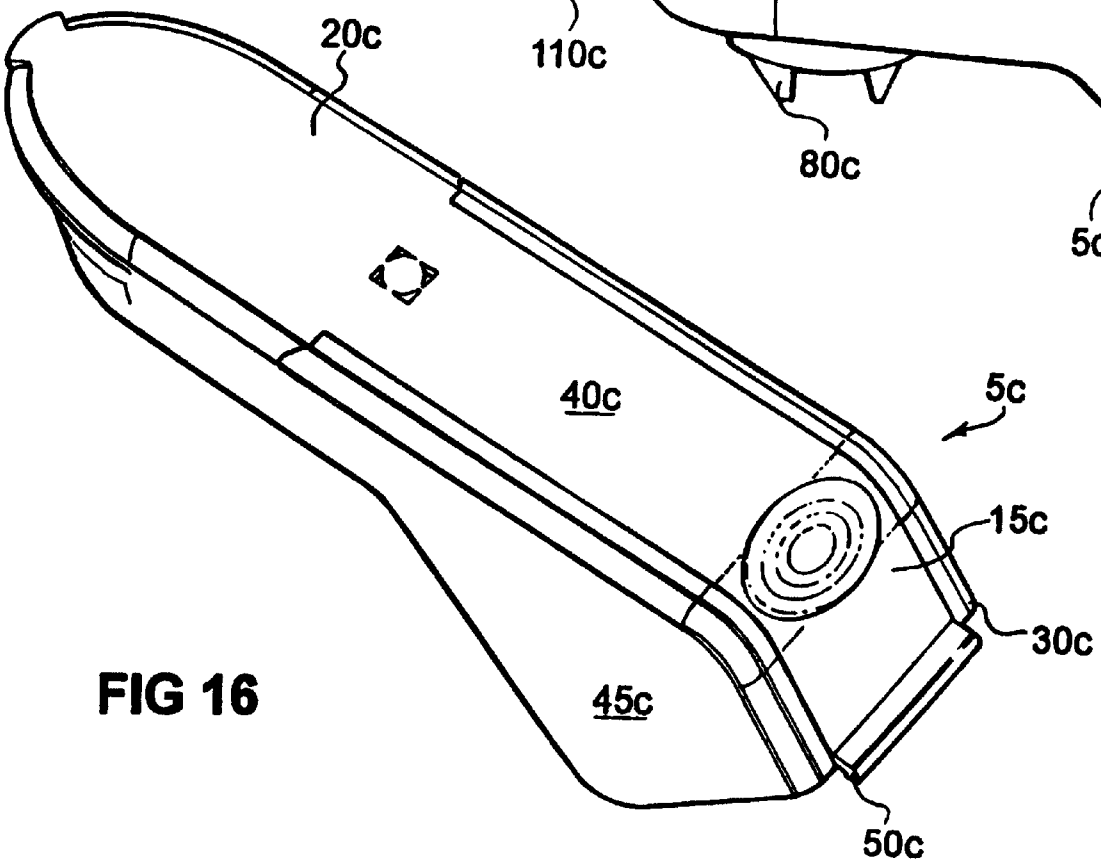

Embodiments of the present invention will now be described by way of example only with reference to the accompanying drawings, which are:

FIG. 1 a sectional side view of a first embodiment of a pouring device according to the present invention in an assembled first, non-pouring position fitted to a container;

FIG. 2 a partial sectional top view of the pouring device of FIG. 1;

FIG. 3 a perspective view to one side and above of the pouring device of FIG. 1 in a disassembled position;

FIG. 4 (*a*) a schematic sectional side view of the pouring device of FIG. 1 in the first, non-pouring position;

FIG. 4 (*b*) a schematic sectional side view of the pouring device of FIG. 1 in an assembled second, pouring position;

FIG. 5 a partial perspective view to one side and the rear of the pouring device of FIG. 1 in the first position attached to a container;

FIG. 6 a partial perspective view to one side and the rear of the pouring device of FIG. 1 in the second position attached to a container;

FIG. 7 a partial perspective view to the other side and the front of the pouring device of FIG. 1 in the second position attached to a container;

FIG. 8 a partial perspective view to one side and the rear of a second embodiment of a pouring device according to the present invention in a first, non-pouring position attached to a container;

FIG. 9 a partial perspective view to the other side and the front of the pouring device of FIG. 8 in a second, pouring position attached to a container;

FIG. 10 a partial perspective view to one side and behind of the pouring device of FIG. 8 in the second position attached to a container;

FIG. 11 a sectional side view of a third embodiment of a pouring device according to the present invention in an assembled first, non-pouring position;

FIG. 12 a sectional side view of the pouring device of FIG. 11 in an assembled second, pouring position;

FIG. 13 a perspective view to one side and above of the pouring device of FIG. 11 in a disassembled position;

FIG. 14 a perspective view to the other side and below of the pouring device of FIG. 11 in a disassembled position;

FIG. 15 a view from one side of the pouring device of FIG. 11 in the first position; and FIG. 16 a perspective view from one side above and to the rear of the pouring device of FIG. 11 in the first position;

DETAILED DESCRIPTION OF THE PREFERRED EXEMPLARY EMBODIMENTS

Referring firstly to FIGS. 1 to 7 there is illustrated a first embodiment of a pouring device, generally designated 5*a,* according to the present invention attached to a container 10*a*. The pouring device 5*a* comprises a first, rear portion 15*a* and a second, front portion 20*a* and a means for retaining the device 5*a* in association with the container 10*a,* wherein, in a first non-pouring position (i.e., as noted by the solid lines in FIG. 1 and as shown in FIG. 5), the second portion 20*a* is in sealing engagement with the container 10*a* while, in use, depressing of the first portion 15*a* causes at least part of the second portion 20*a* to move from the first non-pouring position to a second pouring position (i.e., as shown in dashed line in FIG. 1 and as shown in FIG. 6).

A first living hinge 25*a* is provided between the first and second portions 15*a,* 20*a*. Further a second living hinge 30*a* is formed at a rearmost end of the first portion 15*a*. The first portion 15*a* is of an angled (arcuate) planar form, while the second portion 20*a* has a pivot point 35*a* provided thereupon spaced from the first hinge 25*a*.

Thus, in use, depression of the first portion 15*a* causes flexure of the first hinge 25*a,* thereby causing the second portion 20*a* to pivot about the pivot point 35*a,* the at least part of the second portion 20*a* thereby being caused to move from the first non-pouring position to the second pouring position.

In this embodiment the device 5*a* comprises a first body part 40*a* which carries the first and second portions 15*a,* 20*a* and also a second body part 45*a* which carries the means for retaining the device 5*a* in association with the container 10*a*. The first and second body parts 40*a,* 45*a,* are retained in association with one another by a third hinge 50*a*.

Biasing means in the form of a moulded spring 55*a* are provided such that, in use, ceasing depression of the first portion 15*a* causes the spring 55*a* to urge the first and second portions 15*a,* 20*a* to readopt the first non-pouring position.

The second portion 20*a* carries first and second lugs 60*a,* 65*a* at the pivot point 35*a,* which lugs 60*a,* 65*a* are capable of being received within corresponding first and second recesses 70*a,* 75*a* formed in the second body part 45*a*.

Further the second portion 20*a* carried sealing means 80*a* which, when the second portion 20*a* is in the first position causes a seal to be formed between the device 5*a* and a pouring aperture 85*a*. In this embodiment the pouring aperture 85*a* is not formed on the device 5*a* but is provided on the container 10*a*. However, it should be appreciated that in a modification, such as in the embodiment shown in FIGS. 11 to 16, the pouring aperture 85*a* may be formed on the second body part 45*a*.

In the first embodiment the sealing means 80*a* are in the form of a frusto-cylindrical body providing an inverted V-shaped slot 90*a* at a front most portion thereof.

The second body part 45*a* carries a plurality of inwardly facing lugs or clips 95*a* which, in use, co-act with respective aperture or recesses 100*a* formed in the container 10*a* to retain device 5*a* and container 10*a* together.

The device 5*a* provides tamper evident means, comprising frangible tamper evident lugs 105*a* formed between the first portion 15*a* (or second portion 20*a*) and the second body part 45*a,* first depression of the first portion 15*a* causing the tamper evident lugs 105*a* to shear.

The device 5*a* further provides a frangible transit lock comprising frangible seal(s) 110*a* between the first and second body parts 40*a,* 45*a,* which seal(s) 110*a* is/are broken by depression of the second portion 20*a.*

The device 5*a* may be made in one piece of a suitable moulded plastics material.

In use, a user may hold the container 10*a* with one hand by means of a handle 115*a* and with a thumb/finger of that hand depress the first portion 15*a* of the device 5*a* thereby causing the second portion 20*a* to move to the second position allowing pouring of contents of the container 10*a.*

Due to provision of spring 55*a* releasing of the first portion 15*a* causes the second portion 20*a* to readopt the first non-pouring position thereby closing the container 10*a.*

Referring now to FIGS. 8 to 10 there is illustrated a second embodiment of a pouring device 5*b* according to the present invention attached to a container 10*b.* Parts of the device 5*b* are identified by the same numerals as employed in the device 5*a* of the first embodiment but suffixed with 'b' rather than 'a'.

The device 5*b* provides a tamper evident band 120*b* on the second portion 20*b* and the second body part 45*b,* which when the device 5*b* is used for the first time breaks but is retained on the second portion 20*b.*

Finally, referring to FIGS. 11 to 16 there is illustrated a third embodiment of a pouring device 5*c* according to the present invention attached to a container 10*c.* Parts of the device 5*c* are identified by the same numerals as employed in the device 5*a* of the first embodiment but suffixed with 'c' rather than 'a'.

The device 5*c* is similar to the device 5*a* in many respects. However, the device 5*c* provides an alternative form of moulded spring 55*c,* and further provides a pouring aperture 85*c* integrally formed on the second body part 45*c.*

It should be appreciated that the embodiments of the invention hereinbefore described are given by way of example only and are not meant to limit the scope of the invention in any way.

What is claimed is:

1. A pouring device for a container that is suitable for liquids or fluids, comprising:

a first body part which carries a first rear portion and a second front portion, a second body part which carries a retaining means for retaining the device in association with the container, and biasing means; wherein said device has a first non-pouring position in which the second portion is in sealing engagement with the container, and a second, pouring, position, so that depression of the first portion causes at least part of the second portion to move from the first non-pouring position to the second pouring position, and cessation of depression of the first portion causes the biasing means to urge the first and second portions to readopt the first non-pouring position.

2. The pouring device as recited in claim 1, wherein the first portion comprises a bent planar form.

3. The pouring device as recited in claim 1, wherein said first portion has a thumb- or finger-receiving depression.

4. The pouring device as recited in claim 1, wherein the first and second body parts are retained in association with one another by a third hinge.

5. The pouring device as recited in claim 1, wherein the second portion carries first and second lugs at a pivot point, said lugs capable of being received within corresponding first and second recesses formed in the second body part.

6. The pouring device as recited in claim 1, wherein a pouring aperture is formed on the second body part.

7. The pouring device as recited in claim 1, wherein the second body portion carries one or more inwardly facing lugs or clips which, in use, co-act with respective apertures or recesses formed in the container to retain the device and container together.

8. The pouring device as recited in claim 1, wherein the device is made of a molded plastics material.

9. The pouring device as recited in claim 1, wherein the second portion carries sealing means which, when the second portion is in the first position, cause a seal to be formed between the device and a pouring aperture.

10. The pouring device as recited in claim 9, wherein the sealing means includes an inverted V-shaped slot at a front most portion thereof.

11. The pouring device as recited in claim 1, wherein the pouring device further includes tamper evident means.

12. The pouring device as recited in claim 11, wherein the tamper evident means comprises frangible tamper evident lugs formed between the first portion or second portion and the second body part, so that depression of the first portion causes the lugs to shear.

13. The pouring device as recited in claim 1, wherein the device further comprises a frangible transit lock.

14. The pouring device as recited in claim 13, wherein the frangible transit lock comprises at least one frangible seal between the first and second body parts, and positioned so that the frangible seal is broken by depression of the second portion.

15. The pouring device as recited in claim 1, further comprising a first hinge between the first and second portions.

16. The pouring device as recited in claim 15, further comprising a second hinge at a rearmost end of the first portion.

17. The pouring device as recited in claim 15, wherein the second portion has a pivot point provided thereupon spaced from the first hinge.

18. A combination comprising a container and a pouring device mounted to said container, wherein said pouring device comprises:

a first body part which carries a first rear portion and a second front portion, a second body part which carries a retaining means for retaining the device in association with the container, and biasing means; wherein said device has a first non-pouring position in which the second portion is in sealing engagement with the container, and a second, pouring, portion, so that depression of the first portion causes at least part of the second portion to move from the first non-pouring position to the second pouring position, and cessation of depression of the first portion causes the biasing means to urge the first and second portions to readopt the first non-pouring position.

19. The combination recited in claim 18, further comprising a handle integral with the container.

20. The combination as recited in claim 18, further comprising a pouring aperture provided on the container.

21. The combination as recited in claim 18, wherein the container is constructed so that it can be used with just one hand.

22. A method of pouring contents from the container recited in claim 18, comprising the steps of:

(a) holding the container with only one hand when the container is in the first, non-pouring, position; then (b) depressing the first portion with the thumb or a finger of the holding hand while tipping the container so as to move the pouring device to the second position, and to pour at least part of the contents of the container through the pouring device; and then (c) releasing the first portion.

23. The method recited in claim 22, wherein step (c) is practiced to cause the second portion to readopt the first non-pouring position, thereby closing the container.

24. The combination as recited in claim 18, wherein the container is suitable for viscous liquids or fluids.

25. The combination as recited in claim 24, wherein the container contains a liquid hydrocarbon which is capable of being poured through said pouring device.

26. The combination as recited in claimed 25, wherein the liquid hydrocarbon is an engine oil.

* * * * *